US007000273B2

(12) United States Patent
Rivera-Wienhold et al.

(10) Patent No.: US 7,000,273 B2
(45) Date of Patent: Feb. 21, 2006

(54) SHAPED BODY PILLOWS AND PILLOWCASES

(76) Inventors: Deborah Rivera-Wienhold, 107 Rustic Ridge, Severna Park, MD (US) 21146; Elizabeth Gradie-Chinn, 1918 Aquinas Dr., Gambrills, MD (US) 21054

( * ) Notice: Subject to any disclaimer, the term of this patent is extended or adjusted under 35 U.S.C. 154(b) by 0 days.

(21) Appl. No.: 10/892,495

(22) Filed: Jul. 16, 2004

(65) Prior Publication Data

US 2005/0066443 A1 Mar. 31, 2005

Related U.S. Application Data

(60) Provisional application No. 60/566,172, filed on Apr. 29, 2004, provisional application No. 60/487,583, filed on Jul. 17, 2003.

(51) Int. Cl.
*A47C 20/00* (2006.01)

(52) U.S. Cl. ..... 5/632; 5/630; 5/907; 5/639

(58) Field of Classification Search ..... 5/630, 5/632, 639, 490, 904, 907; D6/598
See application file for complete search history.

(56) References Cited

U.S. PATENT DOCUMENTS

| | | | | |
|---|---|---|---|---|
| 1,867,422 | A | 7/1932 | Shapiro | |
| D94,702 | S | 2/1935 | Marks | |
| 2,149,140 | A | 2/1939 | Gonzalez-Rincones | |
| D114,973 | S | 5/1939 | Eckman | |
| 2,795,802 | A | 6/1957 | Myers | |
| D201,492 | S | 6/1965 | Jacobson | |
| 3,327,330 | A | 6/1967 | McCullough | |
| 3,911,512 | A | 10/1975 | Plate | |
| 4,173,048 | A | 11/1979 | Varaney | |
| D258,793 | S | 4/1981 | Rinx | |
| 4,574,412 | A | 3/1986 | Smith | |
| D283,963 | S | 5/1986 | Rowland | |
| 4,624,021 | A | 11/1986 | Hofstetter | |
| 4,670,924 | A * | 6/1987 | Spector | 5/640 |
| 4,754,510 | A | 7/1988 | King | |
| 4,763,369 | A | 8/1988 | Spector | |
| 4,889,512 | A | 12/1989 | Burnett et al. | |
| 4,901,384 | A | 2/1990 | Eary | |
| D308,788 | S | 6/1990 | Boehm | |
| 4,959,879 | A | 10/1990 | Marxhausen | |
| 5,027,457 | A | 7/1991 | Sweet | |
| 5,059,149 | A | 10/1991 | Stone | |
| 5,097,551 | A | 3/1992 | Smith | |
| 5,109,557 | A | 5/1992 | Koy et al. | |
| 5,184,362 | A * | 2/1993 | Yager et al. | 5/490 |
| 5,208,934 | A | 5/1993 | Bachnick et al. | |
| D337,683 | S | 7/1993 | Bowyer | |

(Continued)

*Primary Examiner*—Michael Trettel

(57) ABSTRACT

Shaped body pillows and pillowcases of comfortably curved shapes and hollows are provided. Articles of the invention include pillows and cases having three-dimensional shapes including a headrest portion, a trunk portion, and a tail portion, bounded by arcuate margins which form three-dimensional modified comma shapes or modified J-shapes. Advantageously, shaped pillows and pillowcases of the invention include a comfortable hollow formed between the headrest and trunk portions for supporting the head and other portions of a child's body. Pillows and pillowcases of the invention are provided with at least one character zone for permanently or reversibly holding and displaying one or more characters, such as a kitten, dog, rabbit or mouse. Articles of the invention may comprise one or more pockets or pouches that may be integrated with the design elements of the product, and may comprise a portion of the one or more characters.

35 Claims, 8 Drawing Sheets

U.S. PATENT DOCUMENTS

| | | | | | |
|---|---|---|---|---|---|
| D368,823 | S | | 4/1996 | Cancellieri | |
| 5,509,157 | A | | 4/1996 | Story | |
| 5,515,563 | A | | 5/1996 | Chao | |
| D372,392 | S | | 8/1996 | Bala | |
| D382,163 | S | | 8/1997 | Hartney | |
| D409,038 | S | | 5/1999 | Rojas, Jr. et al. | |
| D416,745 | S | | 11/1999 | Noyes | |
| 5,987,674 | A | * | 11/1999 | Schaffner et al. | 5/632 |
| D419,819 | S | | 2/2000 | Bartoli | |
| 6,055,687 | A | | 5/2000 | Matthews | |
| 6,061,854 | A | * | 5/2000 | Crowley | 5/655 |
| 6,088,854 | A | | 7/2000 | Brownrigg | |
| D431,745 | S | | 10/2000 | Jackson | |
| 6,233,763 | B1 | | 5/2001 | Spaan | |
| D447,376 | S | | 9/2001 | Kramer | |
| 6,349,437 | B1 | | 2/2002 | Horning | |
| 6,427,267 | B1 | | 8/2002 | Turner | |
| 6,434,769 | B1 | | 8/2002 | Koenig | |
| D464,520 | S | | 10/2002 | Bond | |
| 6,499,164 | B1 | * | 12/2002 | Leach | 5/632 |
| 6,751,817 | B1 | * | 6/2004 | Leach | 5/632 |
| 6,874,183 | B1 | * | 4/2005 | Taylor | 5/632 |

* cited by examiner

SHAPED BODY PILLOWS AND PILLOWCASES

CROSS-REFERENCE TO RELATED APPLICATIONS

The present application claims the benefit of U.S. Provisional Patent Application Ser. No. 60/487,583, filed Jul. 17, 2003; and U.S. Provisional Patent Application Ser. No. 60/566,172, filed Apr. 29, 2004. The entireties of both of these applications are hereby incorporated by reference.

FIELD OF THE INVENTION

The invention relates generally to shaped pillows and to pillowcases that are adapted, or adaptable, for use with shaped and other pillows. More particularly, the invention provides a series of combinations of juvenile pillows and pillowcases or body pillows having exterior decorations which "characterize" the pillow into a huggable, two or three-dimensional animal or other character.

BACKGROUND OF THE INVENTION

Conventional pillows provide head and neck support to resting or sleeping individuals. Body pillows are typically longer and more substantial pillows that provide support for one or more of the head, neck, spine, back, torso and legs of a user. Body pillows are generally recognized for their therapeutic value in that they allow individuals to sleep in a fetal position while providing proper support and alignment of the spine with respect to other body parts. Typically, the user of a body pillow lies on his or her side, and wraps one or both arms or legs around the pillow to approximate, for example, a fetal position. The support provided by the pillow is an aid in making sleep more restful and comfortable.

Pillowcases of the invention are typically adaptable to cover both standard pillows and body pillows. They can be made from any number of fabrics such as plain cotton fabric or more luxurious fabrics such as satin or silk, for example. While a significant function of a pillowcase is to protect the pillow from becoming soiled, pillowcases can provide a decorative or design function as well. Pillowcases can be removed from the pillow and be replaced by a pillowcase of different color or design thus contributing to a change in room theme or mood. Pillows may have additional functions. For example, pillows intended for use by children can function to provide the security in the same manner as the comfort provided by stuffed animals, comforters or blankets, especially at bedtime. A variety of conventional pillows and pillowcases have attempted to meet these functions in the past.

U.S. patents which disclose examples of decorative and dual-purpose pillows and pillowcases include U.S. Pat. No. 5,184,362 to Yager; U.S. Pat. No. 4,763,369 to Spector; and U.S. Pat. No. 6,434,769 to Koenig. A variety of body pillows for both adults and children that provide therapeutic body support and restful sleep are known in the relevant art. Examples of these are found in U.S. Design Pat. No. 382,435 to Schaffner and Powell; U.S. Pat. No. 419,819 to Bartoli, U.S. Pat. No. 431,745 to Jackson, U.S. Design Pat. No. D453,653 to Tunnel and Utility Pat. No. 5,987,674 to Schaffner et al. Schaffner '674 teaches an ergonomically shaped pillow comprising a circumferential section of a toroid combined with first and second ellipsoidal pillow end sections. The pillow of Schaffner et al has portions which are shaped to approximate the circular radii of motion of a user's limbs and head. Tunnel '653 teaches a J-shaped body pillow having straight, flattened, or truncated ends. U.S. Pat. No. 6,499,164 to Leach discloses a body pillow with a horseshoe-shaped top and a J-shaped bottom. The pillow of Leach is designed to be used to support the back, legs and head of a user.

Current research and data on children and sleep indicate that a significant percentage of children have difficulty falling and staying asleep. Furthermore, current research indicates that general anxiety levels in children have been increasing over the past 50 years. Children often find comfort in a beloved stuffed animal or "security blanket" when stressed, tired or in an unfamiliar setting. Moreover, most children find the presence of favorite music or sounds to be comforting and relaxing at bedtime or naptime. Accordingly, a need exists for juvenile body pillows and pillowcases that are provided in huggable shapes and are decorated with comforting, unique or sophisticated animal or character designs that 1) provide therapeutic body support and physical and emotional comfort to help children relax or sleep, 2) transform the body pillow into an appealing, huggable bedtime or quiet time buddy, and 3) provide means for storing, transporting or otherwise using one or more accessories which improve the relaxation and sleep experience for the user.

SUMMARY OF THE INVENTION

It is therefore an object of the present invention to provide body pillows in therapeutic shapes such as J-shapes and modified comma shapes, and in ergonomic sizes that are adapted, constructed and arranged to help children relax, and to sleep more soundly and comfortably.

It is also an object of this invention to provide soft, comfortable pillowcases decorated with comforting or engaging animal designs, or other appealing three-dimensional character designs such that the body pillow is transformed into a bedtime or quiet time buddy for children.

In accordance with these and other objects, the therapeutic body pillows, uniquely adorned pillowcases, and combinations thereof of the invention, provide the physical and emotional comfort of both a pillow and a plush stuffed toy while also providing a novel approach to improving the quality of children's sleep and relaxation times. This is accomplished by the present invention, in part, by providing a huggable and appealing buddy that offers both emotional and physical comfort. Moreover, the present pillows and pillowcases may be designed and constructed such that a pocket or "secret chamber" is created for storage of one or more favorite comfort items such as a blanket, pajamas, stuffed toy or any number of small items a child might want to store. The present invention thus relates to a series of combinations of shaped juvenile body pillows decorated with characters, or shaped pillowcases decorated with characters, that are constructed and arranged to create a bedtime or quiet time buddy for children that provides physical and emotional comfort and helps to promote sleep and relaxation.

In one preferred embodiment, a pillow of the invention is generally a modified J-shape with a tapering "tail" portion, and is sized to accommodate children from 2½ to 12 years of age. Larger pillows sized for older children are also comprehended by the invention. In some preferred embodiments, a pillow or pillowcase according to the invention has an elongated body with an attached headrest area which approximates a modified "J" shape or modified "comma" shape. The pillow may already be stuffed with soft supportive materials from a variety of sources, natural or synthetic. Rather than being rounded at the corners or curves the pillow is angled, the most significant angle being at the lower outside corner of the pillow. This angling design element at the lower outside corner allows for, among other features, a "secret chamber" when the pillowcase is placed on the pillow. This "secret chamber" is large enough to store a blanket, stuffed toy, pajamas or any other number of small beloved objects.

In some preferred embodiments, a pillow or pillowcase according to the invention may be in the shape of a "modified J"shape, and be provided with rounded corners and curves and a zipper along the longer, outside edge. This allows for a softer, more appealing overall shape and creates a "secret chamber" at the lower outside corner when the pillowcase is zippered over the pillow. The zipper also allows for easier removal and fitting of pillowcase embodiment of the invention over a pillow.

In other preferred embodiments, a pillow or pillowcase according to the invention may be provided in a "modified comma" shape. A modified comma shape according to the invention comprises an elongated body that tapers in a curved manner to a tail end. The tail end is that end which, in normal position to a user, tapers from the headrest portion toward the portion which faces, or is embraced by, a user's arms or legs. The tail end may be pointed, curved or blunted. Thus, in some preferred modified comma embodiments, the margins of the body approximate two curvilinear lines that intersect at a point. In other "comma-shaped" embodiments, the margins of the body approximate two curvilinear arcs that approach one another and then intersect only as the arcs abruptly curve toward one another to form a "comma-with-a-soft-end," or blunted shape. In accordance with other aspects, a pillow or pillowcase according to the invention may be any type of form fitted, modified-comma shape with rounded corners and curves and a zipper along the outside, or longer, edge.

In some preferred embodiments of the invention, the outer tip of the headrest portion of the pillow broadens and curves around behind the child's head to provide body support and give a sense of comfort and security. The angle and construction of the pillow or pillowcase where the headrest and elongated body of the pillow meet is configured to allow flexibility and help the headrest to curve around the child's head and assist in providing body support and a sense of comfort and security. The elongated portion may narrow or widen at the bottom or top to provide greater comfort for different age groups and heights.

The connection angle between the elongated portion of the pillow and the head rest portion of the pillow is preferably disposed to bend easily and accommodate different positions. This flexibility also allows for the child to place his or her shoulder snugly into the angle where the elongated portion of the pillow meets the headrest portion, thus allowing for greater comfort and a sense of security. In some preferred embodiments of the invention, there may be variations in circumference of the elongated portion of the pillow body between the points where the elongated body connects to the head rest and the bottom of the elongated body. Preferably, the tail end of a modified comma shape pillow or pillowcase of the invention is disposed to curve inwardly, or in the same direction as the headrest so that it is available to tuck between a child's legs.

The zipper or closure aspect of the invention may be disposed in any location. In some preferred embodiments of the invention, the zipper may be placed on the inner curve of the pillowcase running from the outer tip of the headrest down to the bottom end of the pillowcase. The zipper may be a variety of lengths depending on the pillow shape configuration based on factors such as the target age groups and sizes of children in the target market.

A pillowcase or pillow according to the invention may be made from any material or combination of materials that can be assembled to maintain a desired shape while affording comfort to the user. For example, a pillow shell or pillowcase of the invention can be assembled from a plethora of fabrics such as cotton, linen, velvet, wool or other natural fiber fabrics, or from nylon, satin or other synthetic fabrics. Especially preferred for the outer surface of a pillowcase or pillow according to the invention are one or more soft fabrics such as plush cotton, velvet or fleece. Advantageously, a pillowcase or pillow shell according to the invention may be formed, for example, of two J-shaped or comma-shaped pieces of fabric sewn together along all seams with a zippered closure on the longer, outside edge of the pillowcase. In such embodiments, pillow stuffing, batting, or one or more pillows, may be used to give fill, or loft, in order to provide outwardly biasing forces against the fabric and thereby inflate the fabric sides into the desired three-dimensional shape, the margins of which are determined by the fabric shell.

The invention also comprehends embodiments wherein an animal or character design is cut from the same type of fabric. The design is preferably sized such that it takes up a large portion of space along the elongated body portion of the pillowcase. A similarly sized corresponding design may be cut, for example, from low, medium or high loft batting and aligned with the fabric design cut. This combination is then sewn onto the elongated portion of the pillowcase and enhanced with decorative stitching to create a sophisticated, plush-like three-dimensional image. The placement of the design on the pillowcase may be in one of numerous positions but preferably is positioned on the portion of the body pillow that is hugged by a child thus enhancing the comforting and appealing nature of the pillow. The animal or character design can be made from a variety of different colored fabric to create interest, depth, texture and contrast. Pillowcases according to the invention, when placed over a corresponding pillow, present numerous novel combinations. The result is a therapeutic sleep and relaxation aid for children which provides emotional and physical comfort by creating a soft, three-dimensional bedtime or quiet time buddy to hug and cuddle.

A patch pocket or hidden pocket may be provided on a pillowcase according to the invention. The pocket may be provided in any location on the pillowcase but is preferably located in a location convenient for the storage of desired items, such as on the back of the pillowcase body. In another aspect, the pocket may be in any position that is constructed and arranged to provide storage space for, for instance, toys, a book, a radio, tape recorder, child monitoring device or media player. Preferable positions for the pocket include on the backside of the pillowcase, at the bottom or lower end of the elongated portion, and beneath a portion of the character featured on the face of the pillowcase such that the entrance or access slit to the pocket coincides with one or more margins of the character design, such as an ear. Moreover, a detachable carrying strap with clips or hook-and-loop fasteners can also be provided. The strap may be attached in any way consistent with use of the invention, such as clips or hook-and-loop fasteners. Hook-and-loop fasteners may also be provided for attachment to two or more loops. Preferable positions for the loops are on the seam at the headrest portion of the pillowcase and on the inner seam of the elongated portion of the pillowcase. This allows the pillow to be carried in various manners, for instance, over the shoulder or by hand. As one of skill in the ergonomics of sleep aids and pillows will appreciate, two or more attachment loops may be placed at several positions on the pillowcase in order to allow the carrying elements to be adapted to fit a particular size of child or a particular carrying configuration.

In addition to a patch pocket or hidden pocket on the front surface of a pillow or pillowcase according to the invention, an additional storage element may be provided. For example, on the reverse side of the elongated portion of a pillow or pillowcase of some embodiments of the invention, a "secret chamber" or patch pocket may be placed to allow for storage sufficiently large to accommodate a blanket, stuffed toy, pajamas, child monitoring device, or any other number of beloved objects.

The invention thus combines three main features: A) a body pillow in a modified comma-shape or in a modified J-shape constructed and arranged to accommodate and support portions of the body of a child, B) the buddy factor of a character or stuffed animal, and C) the accessory factor of providing pockets or compartments for the storage of personal effects, a radio or music player, a favorite recording, for example, of a bedtime story or of soothing music. Additionally, in some embodiments, the invention provides means for reversibly interchanging two or more identities of character inserts to be positioned on the pillowcase, that is, a "character zone". The character zone of a pillow or pillowcase according to the invention may be of any shape that will lend itself to ease of manufacture and the reasonable depiction of one or more desired characters. Such characters, which may be attached by any means convenient to manufacture and use including sewing, adhesives, dye imprinting. As an additional advantage, the character zone, and the one or more characters to inhabit that zone, may be constructed and arranged so that the pillowcase and character portion, or module, may be reversibly separated for variety, or for dry cleaning or laundering. The characters may be reversibly attached, for example, by hook-and-loop fasteners.

Pillows and pillowcases of the invention may depict any type of actual, fictional or fantasy character such as a rabbit, cat, kitten, tadpole, dog, puppy, bird, bear, cow, snake, sheep, goat, rat, mouse, horse, cartoon character, historical character, fictional character or any other character as desired. The numerous combinations of the invention create bedtime or quiet time buddies which provide both therapeutic body support and physical and emotional comfort to help children relax and/or sleep.

DETAILED DESCRIPTION OF THE INVENTION

Figure 1:
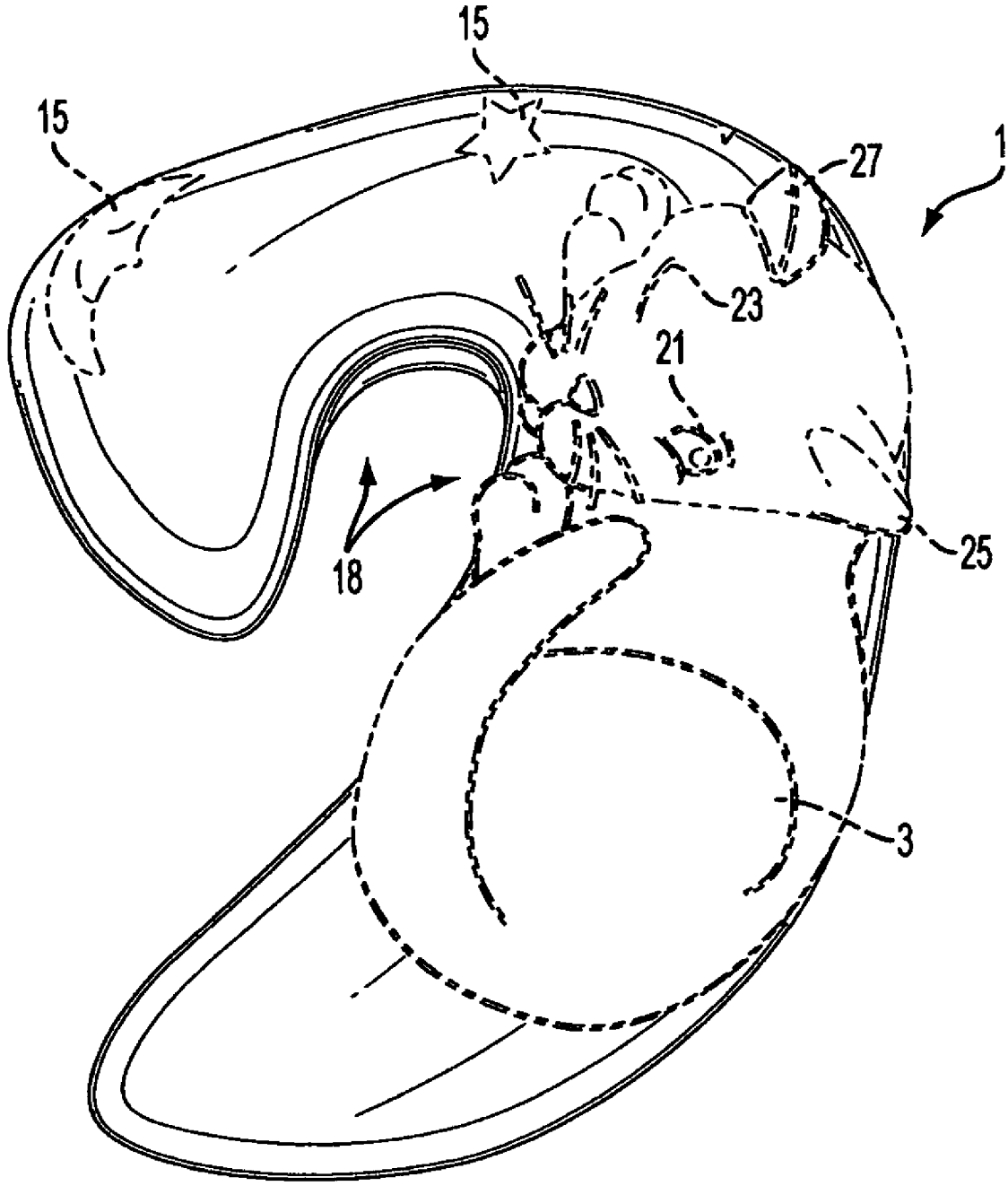
FIG. 1 is a front plan view of an embodiment of a modified comma-shaped pillowcase according to the invention and shows a depiction of a kitten, or cat, thereon.

The present invention relates to a series of body pillows and pillowcases which are provided in comforting and comfortable shapes. In one embodiment of the invention, a body pillow comprises a shape having a headrest portion, a trunk portion, and a tail portion, wherein the headrest portion is bounded by arcuate, that is, curved, margins, the margins being of non-circular curvature, wherein the trunk portion is bounded by arcuate margins, the trunk margins extending contiguously from the headrest margins and forming the trunk portion, and wherein the tail portion is bounded by arcuate margins, the margins of the tail portion being of non-circular curvature and extending contiguously from the arcuate margins of the trunk portion such that a hollow is formed between the headrest portion and the trunk portion.

Preferably, the headrest portion, trunk portion, and tail portion are formed primarily of fabric or fabric-like materials. A body pillow of the invention, further comprises a front surface and a back surface, the surfaces being constructed and arranged to form a cavity, the cavity being provided with sufficient filler material, such as one or more pillows, natural fowl down, synthetic down, pillow stuffing, one or more inflatable bladders, natural batting, or synthetic batting to provide a desired thickness and loft to the pillow. In accordance with other aspects of the invention, the front surface of a pillow or pillowcase of the invention comprises at least one character zone, the character zone being constructed and arranged to display at least one character. In some embodiments of the invention, the one or more character zones are constructed and arranged to reversibly receive one or more characters. A character suitable for use with a pillow or pillowcase according to the invention can depict anything, but preferably include one or more characters from the group consisting of cartoon characters, historical characters, fictional characters, depictions of real persons, depictions of real animals, and depictions of cartoon animals. Although any animal or depiction can be used with a pillow or pillowcase of the invention, preferred characters include one or more from the group consisting of rabbits, dogs, cats, kittens, puppies, birds, bears, cows, goats, sheep, ferrets, horses, tadpoles, reptiles, amphibians, snakes, mice and rats.

In accordance with additional aspects of the invention, the arcuate margins of a pillow or pillowcase of the invention comprise essentially portions which approximate French curves, for example, wherein the curvature of the margins approximates at least three segments of French curves, or at least four segments of French curves, or at least six segments which approximate French curves. As an additional advantage, a body pillow or pillowcase according to the invention comprises at least one pocket, or "secret chamber," the pocket or chamber being provided with at least one opening constructed and arranged to reversibly receive, store or transport one or more favorite comfort items such as a blanket, pajamas, stuffed toy or any number of small items a child might want to store such as, for instance, toys, a book, a radio, tape recorder, child monitoring device, media player, radio, music player, or a favorite recorder with a recording, for example, of a bedtime story or of soothing music or sounds. The pocket or secret chamber may be provided in any position on or beneath the surface of the fabric of a pillow or pillowcase of the invention. Preferably, a pocket or secret chamber includes at least one opening. The opening can be concealed, obvious, or may comprise a portion of the character zone, or may be formed at least partially within the character.

In yet another advantageous aspect, the hollow formed by the headrest and trunk portions of a pillow or pillowcase of the invention is constructed and arranged to receive portions of the torso of a child or other user of the pillow. In some preferred embodiments, the one or more characters of a body pillow or pillowcase of the invention have a desired thickness, for example, such as where the character comprises an appliqué. In other embodiments, the at least one character is formed in the front surface of the fabric itself, for example, as a part of a print design of the fabric itself. In still other embodiments, the at least one character covers essentially all of the surfaces of the pillow.

In accordance with additional aspects of the invention, the present invention provides a series of pillowcases for forming or receiving a body pillow, a pillowcase of the invention comprises fabric having a headrest portion, a trunk portion, and a tail portion, wherein the headrest portion is bounded by arcuate margins. Preferably, the curved margins are of non-circular curvature, preferably comprising portions of French curves, and the trunk portion is bounded by arcuate margins, the margins extending contiguously from the headrest margins and forming the trunk portion, wherein the tail portion is bounded by arcuate margins, the tail portion margins preferably being of non-circular curvature and extending contiguously from the arcuate margins of the trunk portion. Preferably, the pillowcase further comprises a front surface and a back surface, the front and back surfaces being constructed and arranged to form a cavity, the cavity being suitable for receiving sufficient filler material to provide a desired shape to the pillow, such that a hollow is formed between the headrest portion and the trunk portion.

The invention will now be described with reference to the Figures. FIG. 1 is a front plan view of an embodiment of a modified comma-shaped pillow or pillowcase according to the invention, and shows the depiction of a kitten, or cat, on front surface 4. With respect to FIG. 1, comma-shaped pillowcase 1 according to the invention shows kitten character 3 shown in ghost. Pillows and pillowcases of the invention may depict any type of actual, fictional or fantasy character, for example, a rabbit, dog, cat, kitten, puppy, bird, bear, cow, horse, tadpole, snake, cartoon character, historical character, fictional character or any other realistic, stylized, or cartoon character as desired. In FIG. 1, kitten character 3 has open kitten eye 21, closed kitten eye 23, left kitten ear 25, and right kitten ear 27. A margin of left kitten ear 25 may comprise a pocket access slit (not shown) which provides access to a pocket (not shown) disposed and arranged for storing personal items such as tissue paper or medication, and also suitable for containing electronic items such as a tape player, MP3 player, CD player or a music chip (integrated circuit) having recorded thereon soothing sounds, such as those of the ocean surf, white noise, a lullaby, a holiday song, or a mother's voice. One or more pockets may be disposed in concealed, partially concealed or openly visible locations. FIG. 1 also shows moon and star decorations 15 disposed on the same front surface 4 of pillow or pillowcase 1 as is kitten 3. Pillowcase 1 may be provided also with a zipper, hook and loop fasteners, or other closure device or devices (not shown) for sealing a pillow or other filling, batting or stuffing within pillow or pillowcase 1 to thereby provide volume, or loft, preferably in a soft and comforting manner. Kitten 3 is shown disposed on front surface 4 such that a child positioned at least partly in hollow 18 can embrace kitten 3, thus adding to the comforting aspects of the invention.

Figure 2:
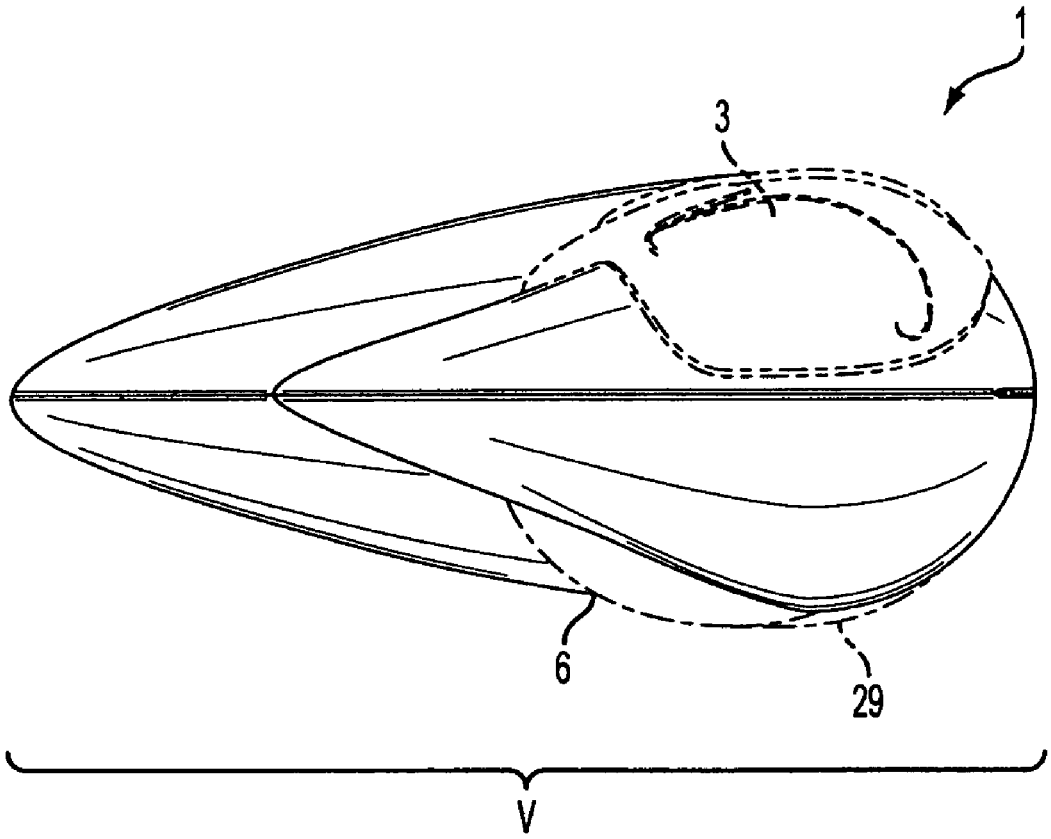
FIG. 2 is a bottom elevation view of the comma-shaped pillow of FIG. 1 according to the invention and depicts portions of kitten character 3 as well as other elements of the embodiment of FIG. 1.

FIG. 2 is a bottom elevation view of the comma-shaped pillow of FIG. 1 according to the invention and depicts portions of kitten character 3 as well as other elements of the embodiment of pillow or pillowcase 1 shown in FIG. 1. A portion of pocket 29 is shown on back surface 6 of pillow or pillowcase 1.

Figure 3:
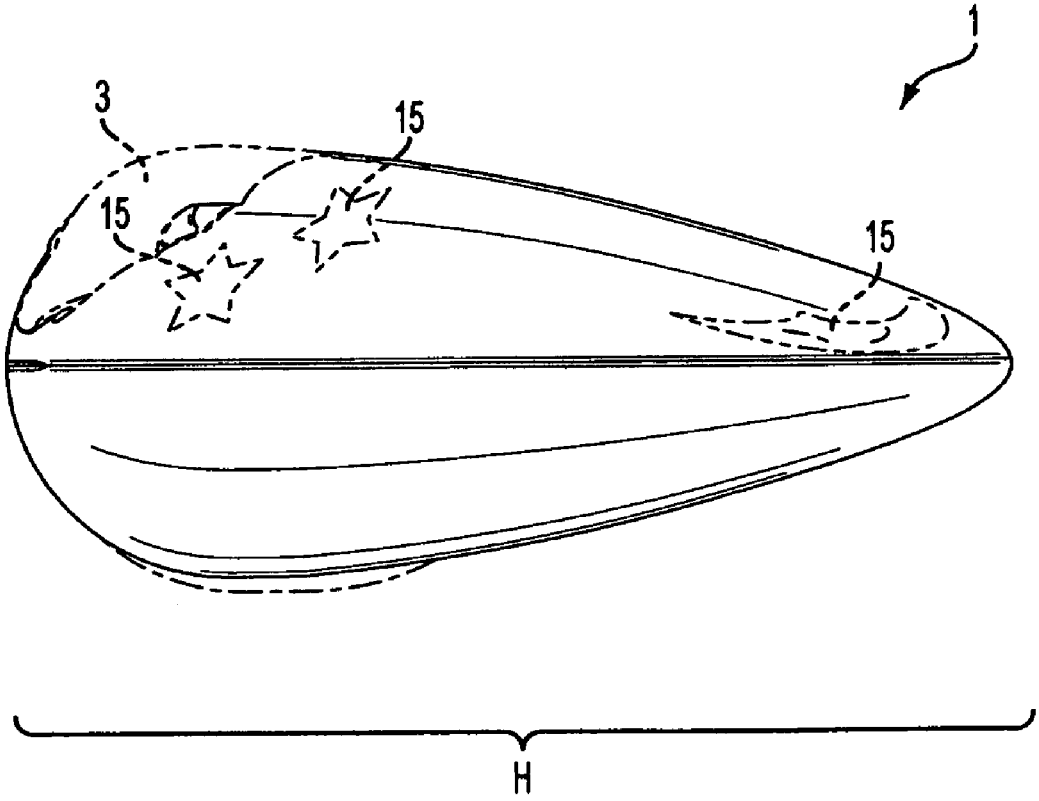
FIG. 3 is a top elevation view of the embodiment of a comma shaped pillowcase of FIG. 1, and depicts portions of kitten character 3 as well as decorative elements 15.

FIG. 3 is a top elevation view of the embodiment of a comma-shaped pillowcase of FIG. 1, and depicts portions of kitten character 3 as well as decorative star elements 15, headrest portion H, and pocket 29.

Figure 4:
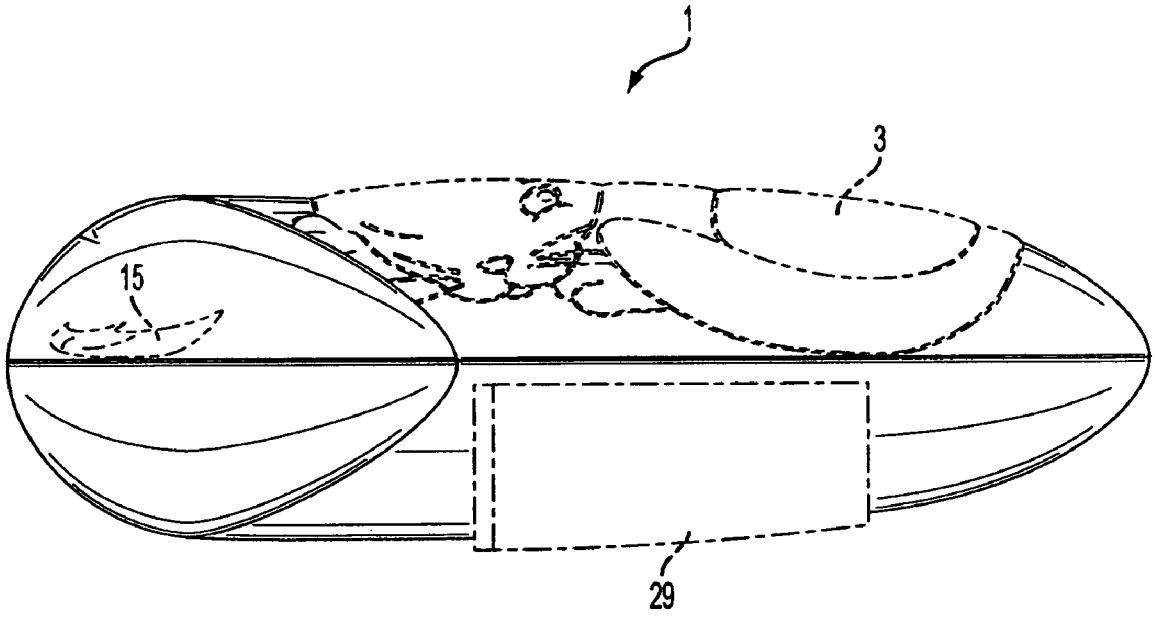
FIG. 4 is a front elevation view of the embodiment of FIG. 1 according to the invention and shows portions of kitten character 3 in ghost as well as portions of pocket 29 disposed on the back surface of pillow 1.

FIG. 4 is a front elevation view of the embodiment of FIG. 1 according to the invention and shows portions of kitten character 3 in ghost as well as portions of pocket 29 disposed on the back surface of pillow 1. In accordance with key aspects of the invention, any type of actual, fictional or fantasy character may be displayed upon, or integrated within portions of a pillow or pillowcase of the invention. Examples of such characters include, but are not limited to, rabbits, dogs, cats, kittens, puppies, birds, bears, cows, horses, tadpoles, snakes, cartoon characters, historical characters, fictional characters, sports characters, or any other real, realistic, stylized, or cartoon character as may be desired.

Figure 5:
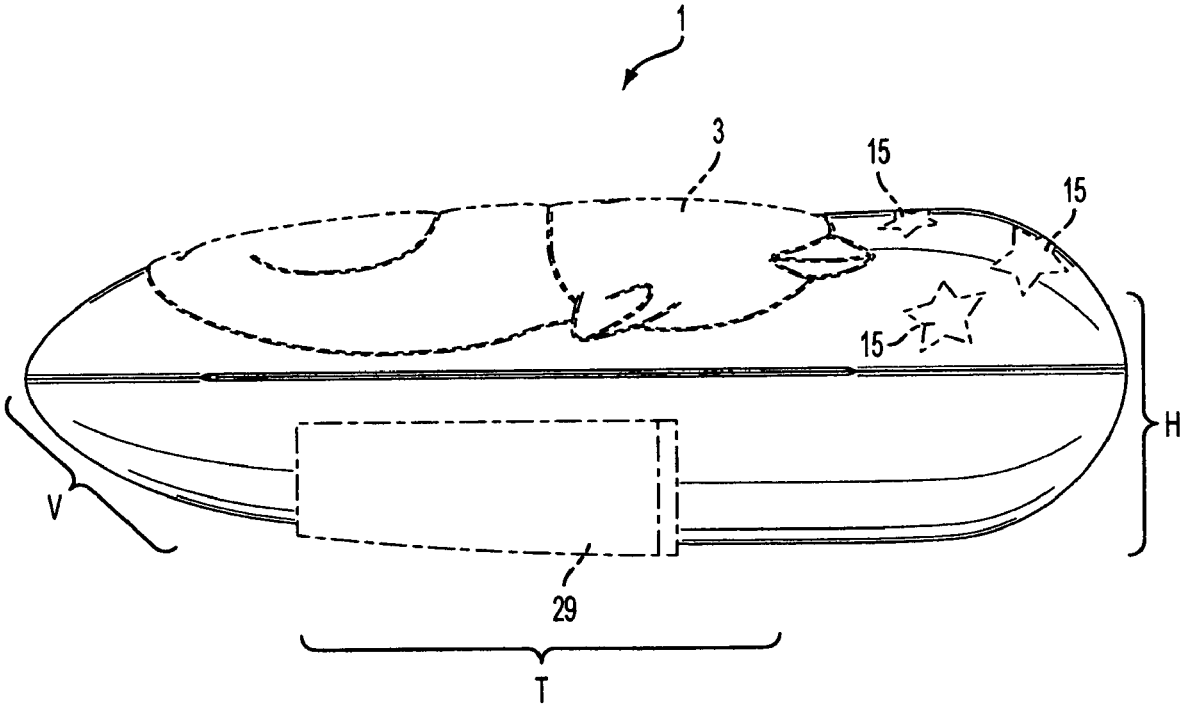
FIG. 5 is a rear elevation view of the embodiment of FIG. 1 and shows

FIG. 5 is a rear elevation view of the embodiment of FIG. 1 and shows a potion of pocket 29, decorative star elements 15, kitten 3, headrest portion H, trunk portion T and tail portion V.

Figure 6:
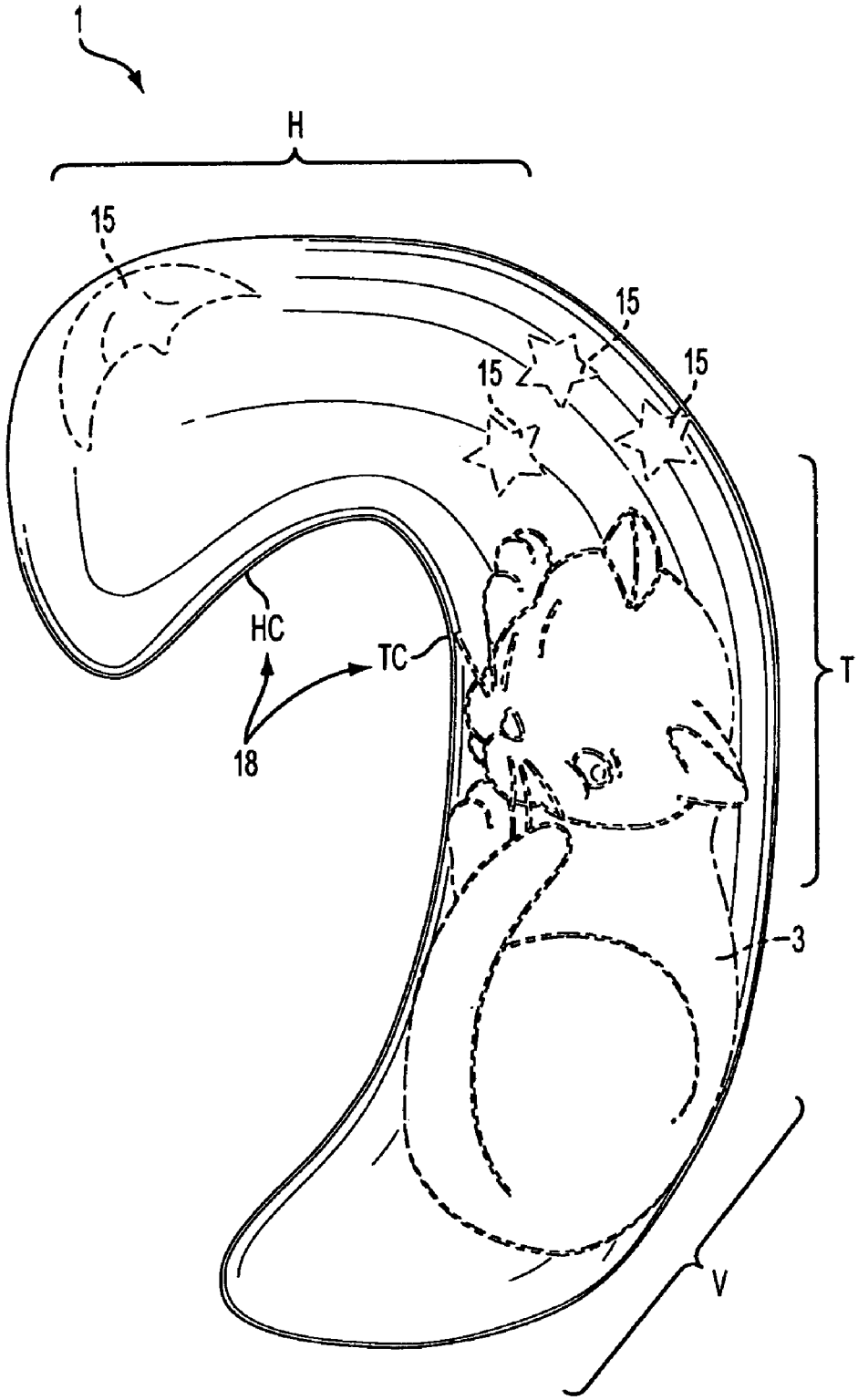
FIG. 6 is a top plan view of an unstuffed pillowcase of the embodiment of FIG. 1 of the invention, and shows kitten character 3, decorative elements 15, and other features of the invention.

FIG. 6 is a top plan view of an unstuffed pillowcase of the embodiment of FIG. 1 of the invention, and shows kitten character 3, decorative star elements 15, and other features of the invention. Pillow 1 includes headrest portion H, trunk portion T and tail portion V. Headrest portion H includes internal curvature HC and trunk portion T includes internal curvature TC. Internal curvatures HC and TC form the margins of hollow 18.

Figure 7:
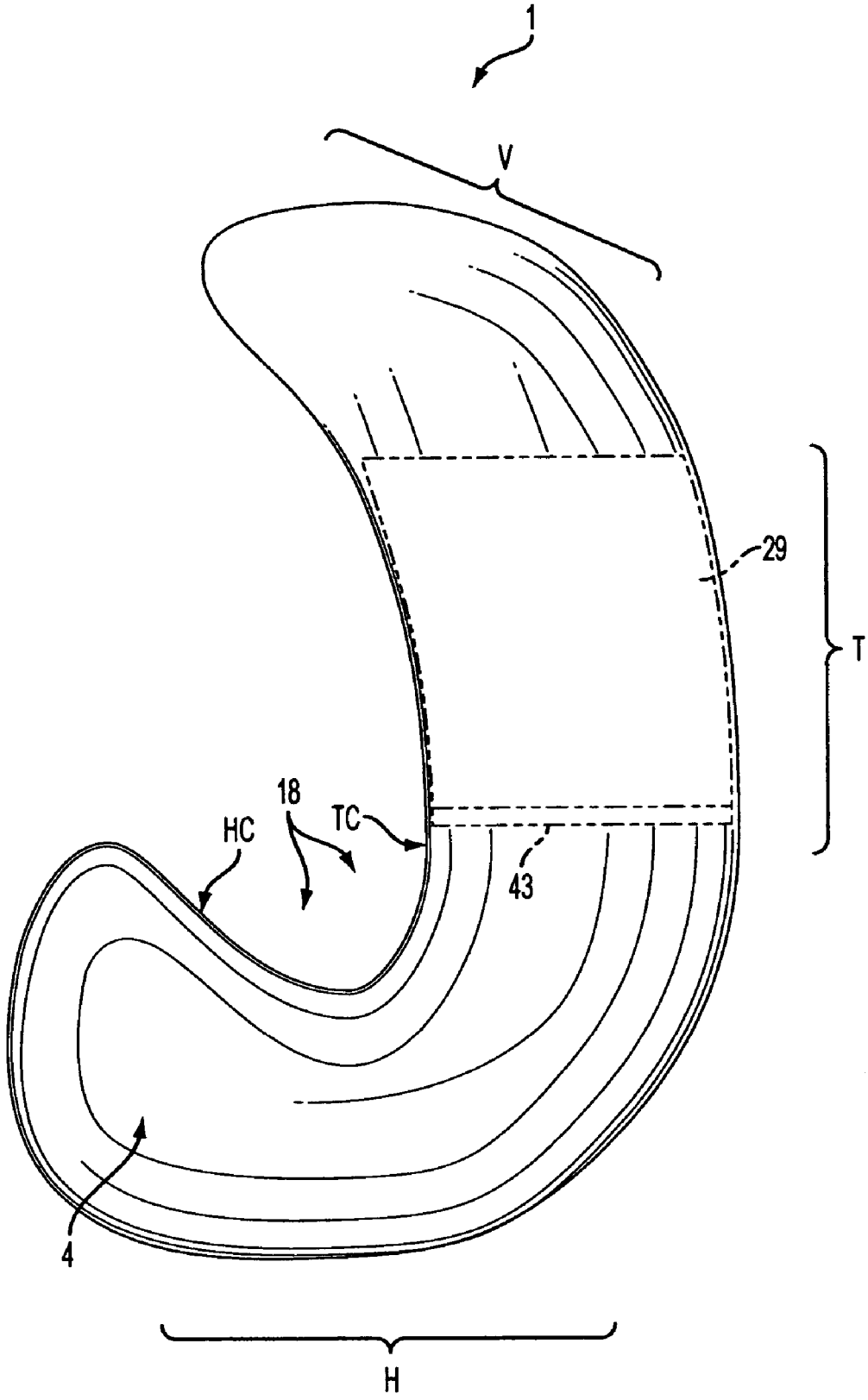
FIG. 7 is a back plan view of the embodiment of FIG. 1, and shows one preferred placement of pocket 29.

FIG. 7 is a back plan view of the embodiment shown in FIG. 1, and shows one preferred placement of pocket 29. Pocket 29 is provided with access slit 43 which can be provided with any type of suitable closure, such as a zipper, hook-and-loop fasteners, or an overlapping cover (not shown). FIG. 7 also shows headrest portion H, trunk portion T and tail portion V of pillow or pillowcase 1. Headrest portion H includes internal curvature HC and trunk portion T includes internal curvature TC. Internal curvatures HC and TC form the margins of hollow 18.

Figure 8:
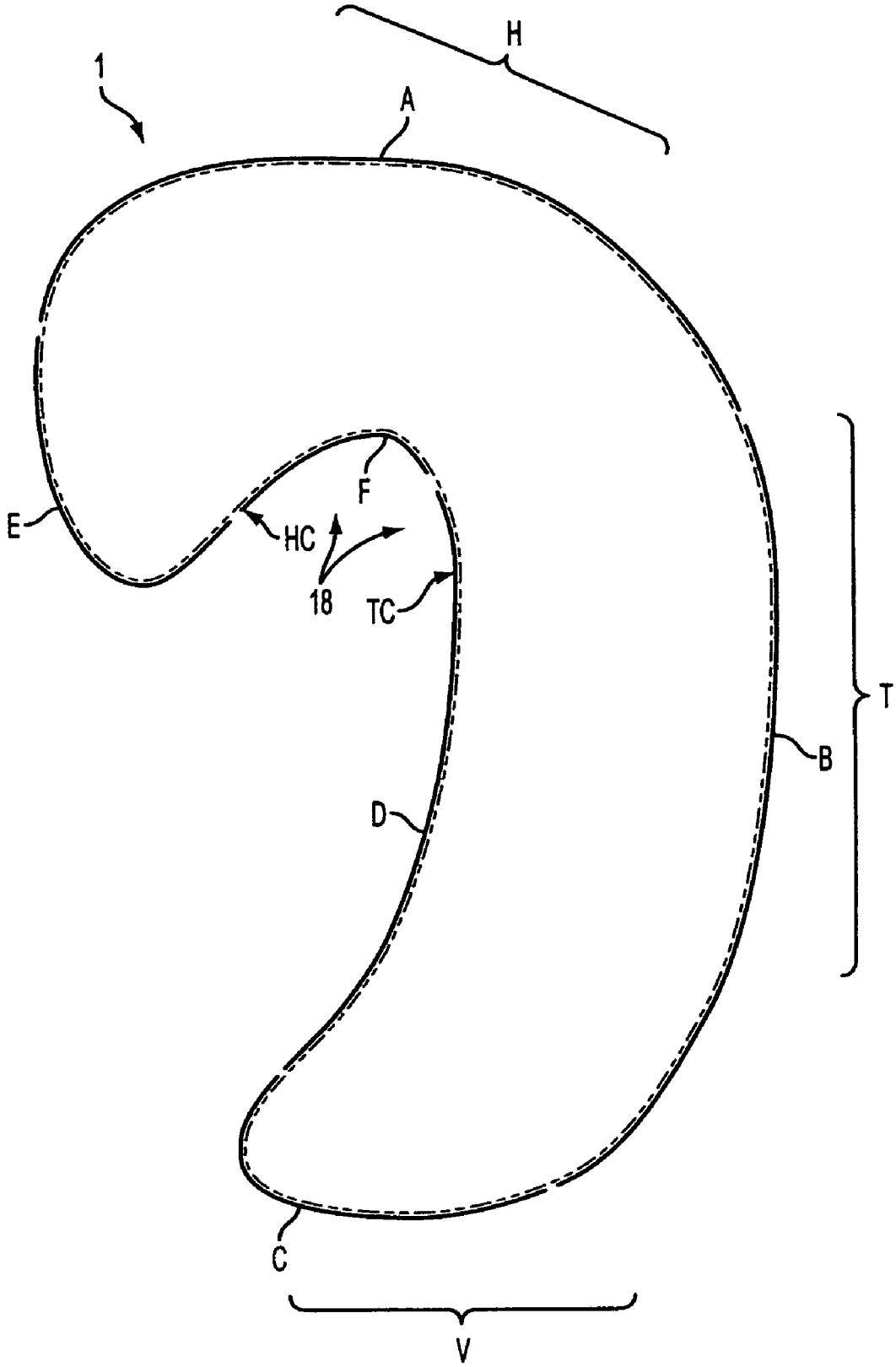
FIG. 8 is a top plan view of the overall shape of the pillowcase of the embodiment shown in FIG. 1, and shows French curve elements A, B, C, D and E superimposed thereon.

FIG. 8 is a top plan view of the overall shape of a pillow or pillowcase of the embodiment shown in FIG. 1, and shows French curve elements A, B, C, D, E and F superimposed thereon. Pillow 1 includes headrest portion H, trunk portion T and tail portion V. Headrest portion H includes internal curvature HC and trunk portion T includes internal curvature TC. Internal curvatures HC and TC form the margins of hollow 18.

As one of skill in the relevant art can appreciate, there are numerous combinations of shapes, character identities, pocket types and locations, and accessories that are included within the scope and spirit of the invention. Moreover, although specific materials are recited herein, the pillows and pillowcases of the present invention may be constructed of any materials, and by any methods, which yield the form and scope of the invention. Accordingly, the scope of the present invention is determined with reference to the present claims, specification and equivalents of the means and materials disclosed herein.

What is claimed is:

1. A body pillow, said body pillow comprising a shape having a headrest portion, a trunk portion, and a tail portion, wherein said headrest portion is bounded by arcuate margins, said margins being of non-circular curvature, wherein said headrest portion comprises a headrest tip, wherein said trunk portion is bounded by arcuate margins, said margins extending contiguously from said headrest margins and forming said trunk portion, and wherein said tail portion comprises a tail tip and wherein said tail portion is bounded by arcuate margins, said margins being of non-circular curvature and extending contiguously from said arcuate margins of said trunk portion such that a hollow is formed between said headrest portion and said trunk portion, and such that said headrest tip and said tail tip are not disposed for being juxtaposed or interconnected with one another to form a torus-like shape.

2. The body pillow of claim 1, wherein said headrest portion, trunk portion, and tail portion are formed primarily of fabric.

3. The body pillow of claim 2, further comprising a front surface and a back surface, said surfaces being constructed and arranged to form a cavity, said cavity being provided with sufficient filler material to provide a desired thickness to said pillow.

4. The body pillow of claim 3, wherein said front surface of said pillow comprises at least one character zone, and wherein said at least one character zone is constructed and arranged to display at least one character.

5. The body pillow of claim 4, wherein said at least one character zone is constructed and arranged to reversibly receive said at least one character.

6. The body pillow of claim 4, wherein said character zone is provided with at least one character, and said character is one or more from the group consisting of cartoon characters, historical characters, fictional characters, depictions of real persons, depictions of real animals, and depictions of cartoon animals.

7. The body pillow of claim 6, wherein said at least one character is one or more from the group consisting of rabbits, dogs, cats, kittens, puppies, birds, bears, cows, goats, sheep, ferrets, horses, tadpoles, reptiles, amphibians, snakes, mice and rats.

8. The body pillow of claim 1, wherein said arcuate margins essentially comprise portions of French curves.

9. The body pillow of claim 8, wherein said curvature approximates at least three segments of French curves.

10. The body pillow of claim 8, wherein said curvature approximates at least four segments of French curves.

11. The body pillow of claim 1, further comprising at least one pocket, said pocket having at least one opening.

12. The body pillow of claim 11, wherein said at least one opening is concealed.

13. The body pillow of claim 11, wherein said at least one opening comprises a portion of said character.

14. The body pillow of claim 11, wherein said pocket is formed at least partially within said character.

15. The body pillow of claim 1, wherein said arcuate margins of said trunk portion comprise essentially portions of French curves, 16.

16. The body pillow of claim 1, wherein said hollow is constructed and arranged to receive portions of the torso of a child or other user of said pillow.

17. The body pillow of claim 5, wherein said at least one character has a desired thickness.

18. The body pillow of claim 5, wherein said at least one character comprises an appliqué.

19. The body pillow of claim 3, wherein said at least one character is formed in said front surface of said fabric.

20. The body pillow of claim 1, wherein said at least one character covers essentially all of said surfaces of said pillow.

21. A pillowcase for forming or receiving a body pillow, said pillowcase comprising fabric having a headrest portion, a trunk portion, and a tail portion, wherein said headrest portion is bounded by arcuate margins, said margins being of non-circular curvature, wherein said headrest portion comprises a headrest tip, wherein said trunk portion is bounded by arcuate margins, said margins extending contiguously from said headrest margins and forming said trunk portion, and wherein said tail portion comprises a tail tip and wherein said tail portion is bounded by arcuate margins, said margins being of non-circular curvature and extending contiguously from said arcuate margins of said trunk portion, said pillowcase further comprising a front surface and a back surface, said surfaces being constructed and arranged to form a cavity, said cavity being suitable for receiving sufficient filler material to provide a desired shape to said pillow, such that a hollow is formed between said headrest portion and said trunk portion, and such that said headrest tip and said tail tip are not disposed for being juxtaposed or interconnected with one another to form a torus-like shape.

22. The pillowcase of claim 21, wherein said filler material is one or more selected from the group consisting of one or more pillows, natural fowl down, synthetic down, pillow stuffing, one or more inflatable bladders, natural batting, and synthetic batting.

23. The pillowcase of claim 21, wherein said arcuate margins essentially comprise portions of French curves.

24. The pillowcase of claim 21, further comprising a front surface and a back surface, wherein said front surface of said pillow comprises at least one character zone, and wherein said at least one character zone is constructed and arranged to display at least one character.

25. The pillowcase of claim 21, wherein said at least one character zone is constructed and arranged to reversibly receive said at least one character.

26. The pillowcase of claim 21, wherein said at least one character is one or more from the group consisting of cartoon characters, historical characters, fictional characters, depictions of real persons, depictions of real animals, and depictions of cartoon animals.

27. The pillowcase of claim 21, wherein said at least one character is one or more from the group consisting of rabbits, dogs, cats, kittens, puppies, birds, bears, cows, goats, sheep, ferrets, horses, tadpoles, reptiles, amphibians, snakes, mice and rats.

28. The pillowcase of claim 21, wherein said arcuate margins approximate at least three segments of French curves.

29. The pillowcase of claim 21, further comprising at least one pocket, said pocket having at least one opening.

30. The pillowcase of claim 21, wherein said at least one opening is concealed.

31. The pillowcase of claim 21, wherein said at least one opening comprises a portion of said character.

32. The pillowcase of claim 21, wherein said pocket is formed at least partially within said character.

33. The pillowcase of claim 21, wherein said hollow is constructed and arranged to receive portions of the torso of a child or other user of said pillow.

34. The pillowcase of claim 21, wherein said at least one character comprises an appliqué.

35. The pillowcase of claim 21, wherein said at least one character is formed in said front surface of said fabric.

* * * * *